US006640722B2

(12) United States Patent
Stögermüller

(10) Patent No.: US 6,640,722 B2
(45) Date of Patent: Nov. 4, 2003

(54) SHELL CAP

(75) Inventor: Johann Stögermüller, Schwanenstadt (AT)

(73) Assignee: Armaturen-GmbH, Rustorf (AT)

( * ) Notice: Subject to any disclaimer, the term of this patent is extended or adjusted under 35 U.S.C. 154(b) by 0 days.

(21) Appl. No.: 10/245,345

(22) Filed: Sep. 18, 2002

(65) Prior Publication Data

US 2003/0051627 A1 Mar. 20, 2003

(30) Foreign Application Priority Data

Sep. 19, 2001 (AU) ..... 1473/2001

(51) Int. Cl.[7] ..... F42B 10/00
(52) U.S. Cl. ..... 102/439
(58) Field of Search ..... 102/439, 501, 102/506, 507

(56) References Cited

U.S. PATENT DOCUMENTS

| | | | | | |
|---|---|---|---|---|---|
| 221,249 | A | * | 11/1879 | Nowlan | 102/506 |
| 451,088 | A | * | 4/1891 | Tunnicliff | 102/506 |
| 484,008 | A | * | 10/1892 | Haskell | 102/524 |
| 760,338 | A | * | 5/1904 | Kwiatkowski | 244/3.23 |
| 791,679 | A | * | 6/1905 | Edmunds | 102/495 |
| 871,825 | A | * | 11/1907 | Schupmann | 102/501 |
| 966,744 | A | * | 8/1910 | Hendrix | 244/3.23 |
| 1,099,298 | A | * | 6/1914 | Hoagland | 102/507 |
| 1,181,849 | A | * | 5/1916 | Coomber | 244/3.23 |
| 1,218,546 | A | * | 3/1917 | Gillis | 102/436 |
| 1,274,281 | A | * | 7/1918 | Kowalski | 102/517 |
| 1,323,532 | A | * | 12/1919 | Hoar | 16/108 |
| 1,767,308 | A | * | 6/1930 | Phillips | 102/507 |
| 3,062,145 | A | * | 11/1962 | Morgan et al. | 102/436 |
| 4,063,511 | A | * | 12/1977 | Bullard | 102/436 |
| 4,184,682 | A | * | 1/1980 | Collins et al. | 473/596 |
| D271,609 | S | * | 11/1983 | Brown | D22/116 |
| 4,644,866 | A | * | 2/1987 | Sullivan | 102/439 |
| 4,700,630 | A | * | 10/1987 | Sullivan | 102/439 |
| 4,718,348 | A | * | 1/1988 | Ferrigno | 102/439 |
| 4,829,904 | A | * | 5/1989 | Sullivan | 102/439 |
| 5,009,164 | A | | 4/1991 | Grinberg | |
| 5,116,224 | A | * | 5/1992 | Kelsey, Jr. | 102/439 |
| 5,121,692 | A | * | 6/1992 | DiCarlo | 102/439 |
| 5,133,261 | A | * | 7/1992 | Kelsey, Jr. | 102/439 |
| 5,164,538 | A | * | 11/1992 | McClain, III | 102/517 |
| 5,569,874 | A | * | 10/1996 | Nelson | 102/507 |
| 5,686,693 | A | * | 11/1997 | Jakobsson | 102/501 |
| 5,698,815 | A | * | 12/1997 | Ragner | 102/502 |
| 5,811,723 | A | * | 9/1998 | Stone | 102/509 |
| 5,932,836 | A | * | 8/1999 | White | 102/529 |
| 6,105,506 | A | * | 8/2000 | Gangale | 102/439 |
| 6,439,124 | B1 | * | 8/2002 | Enlow et al. | 102/501 |
| 6,453,820 | B1 | * | 9/2002 | Anderson | 102/503 |
| 6,481,356 | B2 | * | 11/2002 | Gualandi | 102/439 |

FOREIGN PATENT DOCUMENTS

| | | |
|---|---|---|
| DE | 3326023 A1 | 4/1984 |
| FR | 2762385 | 10/1998 |
| GB | 2125524 | 3/1984 |

* cited by examiner

*Primary Examiner*—Charles T. Jordan
(74) *Attorney, Agent, or Firm*—Wenderoth, Lind & Ponack, L.L.P.

(57) ABSTRACT

A shell cap of plastic material has longitudinal depressions (6) arranged in a radiating configuration, and has additional peripheral grooves (7). The depressions 6 and peripheral grooves 7 form a grid which provides improved bursting certainty.

9 Claims, 1 Drawing Sheet

SHELL CAP

BACKGROUND OF THE INVENTION GROUP

The invention concerns a shell cap of plastic material having a front convex portion which transitions into a cylindrical portion and which is provided with depressions which are arranged in radiating form and which end in the cylindrical portion. A peripheral groove crossing the depressions is formed at the transition between the convex and the cylindrical portions.

A bullet or shell cap of that kind is known, for example, from FR 2 762 385 A. The convex portion of the shell cap is comparatively stable because upon impact it causes deployment of the cylindrical portion. However, it has now been found that, in soft target medium conditions, the impact impulse is too slight to cause that shell cap to burst in spite of the weakening depressions in the longitudinal direction and the peripheral groove.

SUMMARY OF THE INVENTION

The object of the invention is to avoid those difficulties, and this object is achieved by providing at least one additional peripheral groove in the convex portion.

The peripheral grooves which cross the radiating depressions in a right-angled relationship subdivide a large region of the shell cap into areas, between which there are only thin-wall connecting strips. The increased number of desired-fracture locations provided by this arrangement substantially improves the bursting characteristics of the shell cap. In addition, the depressions and grooves facilitate penetration of the soft target medium between the non-weakened areas of the shell cap. Therefore, the spin of the shell generates tangential forces which additionally assist in causing the shell cap to break open.

Preferably the peripheral grooves are deeper than the depressions arranged in a radiating form. The shell cap comprises, for example, a thermoplastic material, in particular a POM.

BRIEF DESCRIPTION OF THE DRAWINGS

The invention is described in greater detail hereinafter with reference to the accompanying drawings, without being limited thereto, in which.

DETAILED DESCRIPTION OF THE INVENTION

Figure 1:
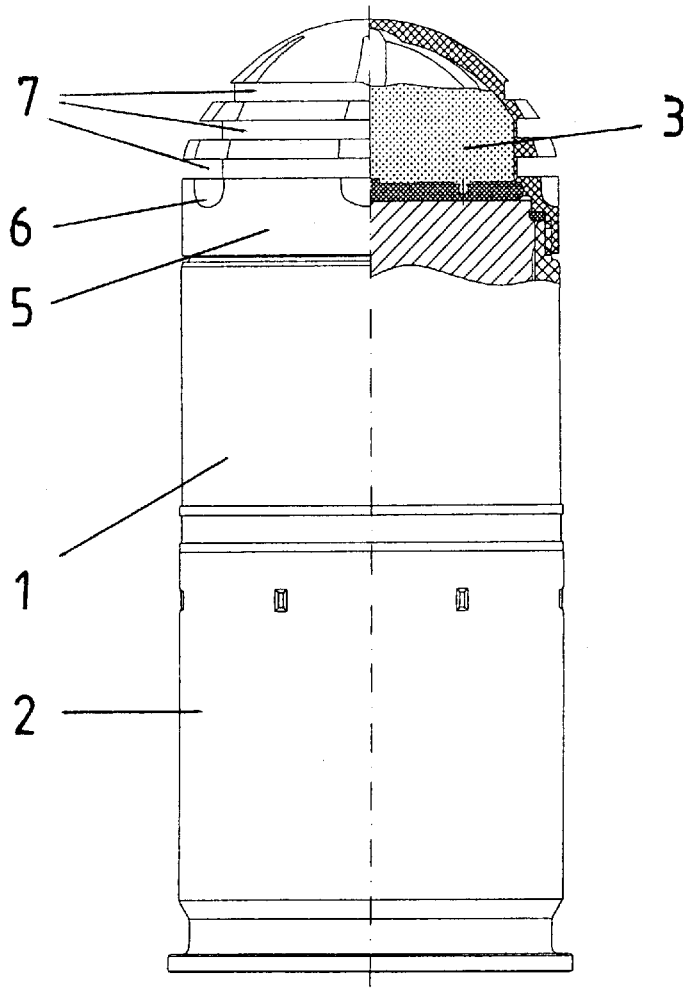
FIG. 1 is a partial longitudinal section of a shell.
Figure 2:
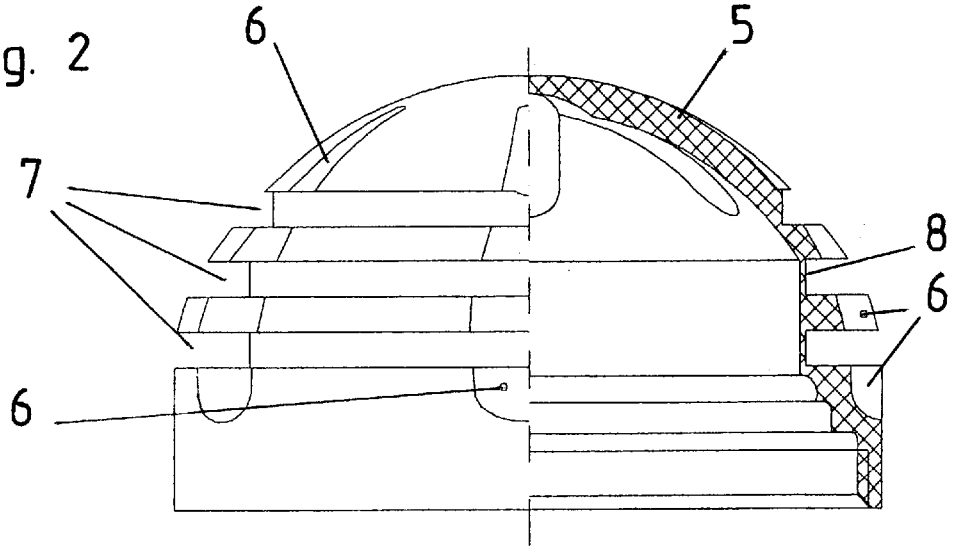
FIG. 2 is a partial longitudinal section of a shell cap.

A non-explosive bullet or shell, in particular of a 40 mm type, has a shell body 1 in which a filling 3, for example dye or paint, which is released at the location of impact, is arranged. The shell body 1 is closed by a shell cap 5 of plastic material having a convex portion transitioning into a cylindrical portion. FIG. 1 also shows a cartridge 2 as the firing device. The shell cap 5 is provided with three peripheral grooves 7 in the convex portion/cylindrical portion transitional area, and the cap wall has only a very small wall thickness 8 at these peripheral grooves 7. In addition, the shell cap 5 is also provided with longitudinal depressions 6 which are arranged in a radiating configuration (i.e., radiate from the center of shell cap 5) and which cross the peripheral grooves 7 at a right angle. The depth of each of the depressions 6 is less than the depth of the peripheral grooves 7. The depressions 6 and the peripheral grooves 7 form a grid pattern of desired-rupture locations, and the grid is laid over a substantial part of the shell cap 5. This grid of depressions 6 and peripheral grooves 7 improves the bursting certainty even upon impact in soft ground or the like.

What is claimed is:

1. A shell cap comprising:

a convex portion;

a cylindrical portion connected to said convex portion, said convex portion and said cylindrical portion being formed of plastic material;

a plurality of depressions arranged in said convex portion and said cylindrical portion so as to radiate from a central region of said convex portion; and a plurality of peripheral grooves formed in said shell cap so as to cross said depressions, at least one of said peripheral grooves being formed at said connection between said convex portion and said cylindrical portion, and at least one of said peripheral grooves being formed in said convex portion, said peripheral grooves being deeper than said depressions.

2. The shell cap of claim 1, wherein said plurality of peripheral grooves comprise two peripheral grooves.

3. The shell cap of claim 1, wherein said plurality of peripheral grooves comprise three peripheral grooves.

4. The shell cap of claim 1, wherein said depressions comprise longitudinal depressions, said peripheral grooves being arranged to cross said longitudinal depressions at right angles so as to form a grid pattern.

5. A shell comprising:

a shell body;

a filling contained within said shell body; and a shell cap attached to said shell body so as to enclose said filling, said shell cap including:

a convex portion;

a cylindrical portion connected to said convex portion, said convex portion and said cylindrical portion being formed of plastic material;

a plurality of depressions arranged in said convex portion and said cylindrical portion so as to radiate from a central region of said convex portion; and a plurality of peripheral grooves formed in said shell cap so as to cross said depressions, at least one of said peripheral grooves being formed at said connection between said convex portion and said cylindrical portion, and at least one of said peripheral grooves being formed in said convex portion, said peripheral grooves being deeper than said depressions.

6. The shell cap of claim 5, wherein said plurality of peripheral grooves comprise two peripheral grooves.

7. The shell cap of claim 5, wherein said plurality of peripheral grooves comprise three peripheral grooves.

8. The shell cap of claim 5, wherein said depressions comprise longitudinal depressions, said peripheral grooves being arranged to cross said longitudinal depressions at right angles so as to form a grid pattern.

9. The shell cap of claim 5, wherein said filling comprises one of dye and paint.

* * * * *

UNITED STATES PATENT AND TRADEMARK OFFICE

CERTIFICATE OF CORRECTION

PATENT NO. : 6,640,722 B2
DATED : November 4, 2003
INVENTOR(S) : Johann Stogermuller It is certified that error appears in the above-identified patent and that said Letters Patent is hereby corrected as shown below:

Title page,
Item [30], Foreign Application Priority Data, replace "Sep. 19, 2001 (AU)" with -- Sep. 19, 2001 (AT) --.

Signed and Sealed this

Ninth Day of March, 2004

JON W. DUDAS
*Acting Director of the United States Patent and Trademark Office*